US007447630B2

(12) United States Patent
Liu et al.

(10) Patent No.: US 7,447,630 B2
(45) Date of Patent: Nov. 4, 2008

(54) METHOD AND APPARATUS FOR MULTI-SENSORY SPEECH ENHANCEMENT

(75) Inventors: Zicheng Liu, Bellevue, WA (US); Michael J. Sinclair, Kirkland, WA (US); Alejandro Acero, Bellevue, WA (US); Xuedong D. Huang, Bellevue, WA (US); James G. Droppo, Duvall, WA (US); Li Deng, Sammamish, WA (US); Zhengyou Zhang, Redmond, WA (US); Yanli Zheng, Urbana, IL (US)

(73) Assignee: Microsoft Corporation, Redmond, WA (US)

( * ) Notice: Subject to any disclaimer, the term of this patent is extended or adjusted under 35 U.S.C. 154(b) by 780 days.

(21) Appl. No.: 10/724,008

(22) Filed: Nov. 26, 2003

(65) Prior Publication Data

US 2005/0114124 A1 May 26, 2005

(51) Int. Cl.
*G10L 21/02* (2006.01)

(52) U.S. Cl. ..... 704/228; 704/226; 381/71.1

(58) Field of Classification Search ..... 704/226, 704/227; 381/71.1, 71.2, 71.9
See application file for complete search history.

(56) References Cited

U.S. PATENT DOCUMENTS

| | | | | |
|---|---|---|---|---|
| 3,383,466 | A | 5/1968 | Hilix et al. | 179/1 |
| 3,746,789 | A | 7/1973 | Alcivar | 179/1 |
| 3,787,641 | A | 1/1974 | Santori | 179/107 |
| 4,382,164 | A | 5/1983 | May, Jr. | 704/233 |
| 4,769,845 | A | 9/1988 | Nakamura | 704/231 |
| 5,054,079 | A | 10/1991 | Frielingsdorf et al. | 381/151 |
| 5,151,944 | A | 9/1992 | Yamamura | 381/151 |
| 5,197,091 | A | 3/1993 | Takagi et al. | 379/433.12 |
| 5,241,692 | A | 8/1993 | Harrison et al. | 455/79 |
| 5,295,193 | A | 3/1994 | Ono | 381/151 |
| 5,404,577 | A | 4/1995 | Zuckerman et al. | 455/66 |

(Continued)

FOREIGN PATENT DOCUMENTS

DE 199 17 169 11/2000

(Continued)

OTHER PUBLICATIONS

U.S. Appl. No. 10/629,278, filed Jul. 29, 2003, Huang et al.

(Continued)

*Primary Examiner*—Talivaldis Ivars Smits
*Assistant Examiner*—Douglas C Godbold
(74) *Attorney, Agent, or Firm*—Theodore M. Magee; Westman, Champlin & Kelly, P.A.

(57) ABSTRACT

A method and system use an alternative sensor signal received from a sensor other than an air conduction microphone to estimate a clean speech value. The estimation uses either the alternative sensor signal alone, or in conjunction with the air conduction microphone signal. The clean speech value is estimated without using a model trained from noisy training data collected from an air conduction microphone. Under one embodiment, correction vectors are added to a vector formed from the alternative sensor signal in order to form a filter, which is applied to the air conductive microphone signal to produce the clean speech estimate. In other embodiments, the pitch of a speech signal is determined from the alternative sensor signal and is used to decompose an air conduction microphone signal. The decomposed signal is then used to determine a clean signal estimate.

15 Claims, 11 Drawing Sheets

U.S. PATENT DOCUMENTS

| | | | | |
|---|---|---|---|---|
| 5,446,789 | A | 8/1995 | Loy et al. | |
| H1497 | H | 10/1995 | Marshall | 704/276 |
| 5,555,449 | A | 9/1996 | Kim | 379/433.03 |
| 5,590,241 | A * | 12/1996 | Park et al. | 704/227 |
| 5,647,834 | A | 7/1997 | Ron | 600/23 |
| 5,692,059 | A | 11/1997 | Kruger | 381/151 |
| 5,701,390 | A * | 12/1997 | Griffin et al. | 704/206 |
| 5,757,934 | A | 5/1998 | Yokoi | 381/68.3 |
| 5,812,970 | A * | 9/1998 | Chan et al. | 704/226 |
| 5,828,768 | A | 10/1998 | Eatwell et al. | 381/333 |
| 5,933,506 | A | 8/1999 | Aoki et al. | 381/151 |
| 5,943,627 | A | 8/1999 | Kim et al. | 379/426 |
| 5,983,073 | A | 11/1999 | Ditzik | 455/11.1 |
| 5,983,186 | A | 11/1999 | Miyazawa et al. | 704/275 |
| 6,006,175 | A | 12/1999 | Holzrichter | 704/208 |
| 6,028,556 | A | 2/2000 | Shiraki | 343/702 |
| 6,029,128 | A | 2/2000 | Jarvinen et al. | 704/220 |
| 6,052,464 | A | 4/2000 | Harris et al. | 379/433 |
| 6,052,567 | A | 4/2000 | Ito et al. | 455/90 |
| 6,094,492 | A | 7/2000 | Boesen | 381/312 |
| 6,125,284 | A | 9/2000 | Moore et al. | 455/557 |
| 6,137,883 | A | 10/2000 | Kaschke et al. | 379/433.07 |
| 6,151,397 | A * | 11/2000 | Jackson et al. | 381/71.4 |
| 6,175,633 | B1 | 1/2001 | Morrill et al. | 381/71.6 |
| 6,243,596 | B1 | 6/2001 | Kikinis | 429/8 |
| 6,266,422 | B1 * | 7/2001 | Ikeda | 381/71.11 |
| 6,289,309 | B1 | 9/2001 | deVries | 704/233 |
| 6,292,674 | B1 | 9/2001 | Davis | 455/550.1 |
| 6,308,062 | B1 | 10/2001 | Chien et al. | 455/420 |
| 6,339,706 | B1 | 1/2002 | Tillgren et al. | 455/419 |
| 6,343,269 | B1 | 1/2002 | Harada et al. | 704/243 |
| 6,377,919 | B1 * | 4/2002 | Burnett et al. | 704/231 |
| 6,389,391 | B1 | 5/2002 | Terauchi | 704/233 |
| 6,408,081 | B1 | 6/2002 | Boesen | 381/312 |
| 6,434,239 | B1 * | 8/2002 | DeLuca | 381/71.2 |
| 6,542,721 | B2 | 4/2003 | Boesen | 455/90 |
| 6,560,468 | B1 | 5/2003 | Boesen | 455/568 |
| 6,590,651 | B1 | 7/2003 | Bambot et al. | 356/338 |
| 6,594,629 | B1 | 7/2003 | Basu et al. | 704/251 |
| 6,664,713 | B2 | 12/2003 | Boesen | 310/328 |
| 6,675,027 | B1 | 1/2004 | Huang | 455/575 |
| 6,707,921 | B2 | 3/2004 | Moore | 381/327 |
| 6,717,991 | B1 * | 4/2004 | Gustafsson et al. | 375/285 |
| 6,738,485 | B1 | 5/2004 | Boesen | 381/312 |
| 6,754,358 | B1 | 6/2004 | Boesen et al. | 381/326 |
| 6,754,623 | B2 | 6/2004 | Deligne et al. | 704/233 |
| 6,760,600 | B2 | 7/2004 | Nickum | 455/557 |
| 6,879,952 | B2 | 4/2005 | Acero et al. | 704/222 |
| 6,959,276 | B2 * | 10/2005 | Droppo et al. | 704/226 |
| 7,054,423 | B2 | 5/2006 | Nebiker et al. | 379/201.01 |
| 7,110,944 | B2 * | 9/2006 | Balan et al. | 704/226 |
| 7,117,148 | B2 * | 10/2006 | Droppo et al. | 704/228 |
| 7,181,390 | B2 * | 2/2007 | Droppo et al. | 704/226 |
| 7,190,797 | B1 | 3/2007 | Johnston et al. | 381/74 |
| 2001/0018655 | A1 | 8/2001 | Yeldener | 704/258 |
| 2001/0027121 | A1 | 10/2001 | Boesen | 455/556 |
| 2002/0035470 | A1 | 3/2002 | Gao | 704/226 |
| 2002/0039425 | A1 | 4/2002 | Burnett et al. | 381/94.7 |
| 2002/0057810 | A1 | 5/2002 | Boesen | |
| 2002/0068537 | A1 | 6/2002 | Shim et al. | 455/177.1 |
| 2002/0075306 | A1 | 6/2002 | Thompson et al. | |
| 2002/0114472 | A1 * | 8/2002 | Lee et al. | 381/71.12 |
| 2002/0118852 | A1 | 8/2002 | Boesen | 381/328 |
| 2002/0173953 | A1 * | 11/2002 | Frey et al. | 704/226 |
| 2002/0181669 | A1 | 12/2002 | Takatori et al. | |
| 2002/0196955 | A1 | 12/2002 | Boesen | |
| 2002/0198021 | A1 | 12/2002 | Boesen | 455/556 |
| 2003/0061037 | A1 * | 3/2003 | Droppo et al. | 704/226 |
| 2003/0083112 | A1 | 5/2003 | Fukuda | 455/568 |
| 2003/0097254 | A1 | 5/2003 | Holzrichter et al. | 704/201 |
| 2003/0125081 | A1 | 7/2003 | Boesen | 455/556 |
| 2003/0144844 | A1 | 7/2003 | Colmenarez et al. | 704/273 |
| 2003/0179888 | A1 * | 9/2003 | Burnett et al. | 381/71.8 |
| 2003/0220786 | A1 | 11/2003 | Chandran et al. | 704/205 |
| 2004/0028154 | A1 | 2/2004 | Yellin et al. | 375/341 |
| 2004/0086137 | A1 * | 5/2004 | Yu et al. | 381/71.11 |
| 2004/0092297 | A1 | 5/2004 | Huang | |
| 2004/0186710 | A1 * | 9/2004 | Yang | 704/226 |
| 2004/0249633 | A1 * | 12/2004 | Asseily et al. | 704/200 |
| 2005/0038659 | A1 | 2/2005 | Helbing | 704/271 |
| 2005/0049857 | A1 | 3/2005 | Seltzer et al. | 704/226 |
| 2006/0008256 | A1 | 1/2006 | Khedouri et al. | 386/124 |
| 2006/0009156 | A1 | 1/2006 | Hayes et al. | 455/63.1 |
| 2006/0072767 | A1 * | 4/2006 | Zhang et al. | 381/71.6 |
| 2006/0079291 | A1 | 4/2006 | Granovetter et al. | 455/563 |

FOREIGN PATENT DOCUMENTS

| | | | |
|---|---|---|---|
| EP | 0 720 338 | A2 | 7/1996 |
| EP | 742 678 | | 11/1996 |
| EP | 0 854 535 | A2 | 7/1998 |
| EP | 0 899 718 | A2 | 3/1999 |
| EP | 0 939 534 | A1 | 9/1999 |
| EP | 0 951 883 | | 10/1999 |
| EP | 1 333 650 | | 8/2003 |
| EP | 1 569 422 | | 8/2005 |
| FR | 2 761 800 | | 4/1997 |
| GB | 2 375 276 | | 11/2002 |
| GB | 2 390 264 | | 12/2003 |
| JP | 3108997 | | 5/1991 |
| JP | 04245720 | | 9/1992 |
| JP | 5276587 | | 10/1993 |
| JP | 8065781 | | 3/1996 |
| JP | 8070344 | | 3/1996 |
| JP | 8079868 | | 3/1996 |
| JP | 08214391 | | 8/1996 |
| JP | 09284877 | | 10/1997 |
| JP | 10-023122 | | 1/1998 |
| JP | 10-023123 | | 1/1998 |
| JP | 11265199 | | 9/1999 |
| JP | 2001119797 | | 10/1999 |
| JP | 2001245397 | | 2/2000 |
| JP | 20002-09688 | | 7/2000 |
| JP | 2000196723 | | 7/2000 |
| JP | 2000250577 | | 9/2000 |
| JP | 2000261529 | | 9/2000 |
| JP | 2000261530 | | 9/2000 |
| JP | 2000261534 | | 9/2000 |
| JP | 2000354284 | | 12/2000 |
| JP | 20012924989 | | 10/2001 |
| JP | 2002-125298 | | 4/2002 |
| JP | 2002-358089 | | 12/2002 |
| JP | 2003143253 | | 5/2003 |
| WO | WO 93/01664 | | 1/1993 |
| WO | WO 95/17746 | | 6/1995 |
| WO | WO 00/21194 | | 10/1998 |
| WO | WO 99/04500 | | 1/1999 |
| WO | WO 00/021194 | | 4/2000 |
| WO | WO 00/45248 | | 8/2000 |
| WO | WO 02/007477 | | 1/2002 |
| WO | WO 02/098169 | A1 | 5/2002 |
| WO | WO 02/077972 | A1 | 10/2002 |
| WO | WO 03/055270 | A1 | 7/2003 |
| WO | WO 2004012477 | | 5/2004 |

OTHER PUBLICATIONS

U.S. Appl. No. 10/785,768, filed Feb. 24, 2004, Sinclair et al.

U.S. Appl. No. 10/636,176, filed Aug. 7, 2003, Huang et al.

O.M. Strand, T. Holter, A. Egeberg, and S. Stensby, "On the Feasibility of ASR in Extreme Noise Using the PARAT Earplug Communication Terminal," ASRU 2003, St. Thomas, U.S. Virgin Islands, Nov. 20-Dec. 4, 2003.

Z. Zhang, Z. Liu, M. Sinclair, A. Acero, L. Deng, J. Droppo, X. D. Huang, Y. Zheng, "Multi-Sensory Microphones For Robust Speech Detection, Enchantment, and Recognition," ICASSP 04, Montreal, May 17-21, 2004.
Search Report dated Dec. 17, 2004 from International Application No. 04016226.5.
European Search Report from Application No. 05107921.8, filed Aug. 30, 2005.
European Search Report from Application No. 05108871.4, filed Sep. 26, 2005.
http://www.snaptrack.com/ (2004).
http://www.misumi.com.tw/PLIST.ASP?PC.ID:21 (2004).
http://www.wherifywireless.com/univLoc.asp (2001).
http://www.wherifywireless.com/prod.watches.htm (2001).
Microsoft Office, Live Communications Server 2003, Microsoft Corporation, pp. 1-10, 2003.
Shoshana Berger, http://www.cnn.com/technology, "Wireless, wearable, and wondrous tech," Jan. 17, 2003.
http://www.3G.co.uk, "NTT DoCoMo to Introduce First Wireless GPS Handset," Mar. 27, 2003.
"Physiological Monitoring System 'Lifeguard' System Specifications," Stanford University Medical Center, National Biocomputation Center, Nov. 8, 2002.
Nagl, L., "Wearable Sensor System for Wireless State-of-Health Determination in Cattle," Annual International Conference of the Institute of Electrical and Electronics Engineers' Engineering in Medicine and Biology Society, 2003.
Asada, H. and Barbagelata, M., "Wireless Fingernail Sensor for Continuous Long Term Health Monitoring," MIT Home Automation and Healthcare Consortium, Phase 3, Progress Report No. 3-1, Apr. 2001.
Kumar, V., "The Design and Testing of a Personal Health System to Motivate Adherence to Intensive Diabetes Management," Harvard-MIT Division of Health Sciences and Technology, pp. 1-66, 2004.
Bakar, "The Insight of Wireless Communication," Research and Development, 2002, Student Conference on Jul. 16-17, 2002.
Zheng Y. et al., "Air and Bone-Conductive Integrated Microphones for Robust Speech Detection and Enhancement" Automatic Speech Recognition and Understanding 2003. pp. 249-254.
De Cuetos P. et al, "Audio-visual intent-to-speak detection for human-computer interaction" vol. 6, Jun. 5, 2000. pp. 2373-2376.
M. Graciarena, H. Franco, K. Sonmez, and H. Bratt, "Combining Standard and Throat Microphones for Robust Speech Recognition," IEEE Signal Processing Letters, vol. 10, No. 3, pp. 72-74, Mar. 2003.
P. Heracleous, Y. Nakajima, A. Lee, H. Saruwatari, K. Shikano, "Accurate Hidden Markov Models for Non-Audible Murmur (NAM) Recognition Based on Iterative Supervised Adaptation," ASRU 2003, St. Thomas, U.S. Virgin Islands, Nov. 20-Dec. 4, 2003.
U.S. Appl. No. 11/156,434, filed Jun. 20, 2005, Zicheng et al.
RD 418033, Feb. 10, 1999.
Australian Search Report and Written Opinion for Foreign Application No. SG 200500289-4 filed Jan. 18, 2005.
The Written Opinion from Foreign Application No. SG 200500289-4, filed Jan. 18, 2005.
The Office Action from Foreign Application No. 121-2005, filed Jan. 21, 2005.
The European Search Report from foreign application No. 04025457.5 filed Oct. 26, 2004.
The European Search Report from foreign application No. 05101071.8 filed Feb. 14, 2005.
Gu, L., et al., "Perceptual Harmonic Cepstral Coefficients for Speech Recognition in Noisy Environment," Proceedings of ICASSP, Salt Lake City, Utah, May 2001.
Ealey, D., et al., "Harmonic Tunneling: Tracking Non-Stationary Noises During Speech," Proceedings of Eurospeech, Aalborg, Denmark, Sep. 2001.
Yegnanarayana,B., et al., "An Iterative Algorithm for Decomposition of Speech Signals into Periodic and Aperiodic Components," IEEE Transactions on Speech and Audio Processing, vol. 6, No. 1, pp. 1-11, Jan. 1998.
Laroche, J., et al., "HNM: A Simple Efficient Harmonic + Noise Model for Speech," Proceedings of IEEE Workshop on Applications of Signal Processing to Audio and Acoustic, Mohonk, NY, Oct. 1993.
Tabrikian, J., et al., "Speech Enhancement by Harmonic Modeling Via Map Pitch Tracking," Proceeding ICASSP 2002, vol. 1, pp. 1549-1552.
European Search Report for corresponding European Application EP 04103533.
First Official Communication for corresponding European Application EP 4103533.8, filed Jul. 23, 2004.
Stylianou, Y., "Applying The Harmonic Plus Noise Model in Concatenative Speech Synthesis," Speech and Audio Processing, IEEE Transactions on vol. 9, No. 1, pp. 21-29, Jan. 2001.
A. Eronen, "Automatic Musical Instrument Recondition," Master of Science Thesis, Department of Information Technology, Tamperer University of Technology, 2001, http://citeseer.ist.psu.edu/eronen01automatic.html.
Virtanen, T.; Klapuri, A., "Separation of Harmonic Sounds Using Linear Models of the Overtone Series," Acoustics, Speech, and Signal Processing, 2002, Proceedings (ICASSP '02), IEEE International Conference on vol. 2, No. pp. 1757-1760, 2002.
Yumoto, Eiji, "Harmonics-to-noise Ratio as an Index of the Degree of Hoarseness," Journal of Acoustical Society of America, pp. 1544-1550, 1982.
Seltzer, Michael, "SPHINXIII Signal Processing Front End Specification," CMU Speech Group Aug. 31, 1999.
Seltzer, Michael, "Automatic Detection of Corrupt Spectrographic Features for Robust Speech Recognition," Master of Science Thesis, Department of Science in Electrical and Computer Engineering, Carnegie Mellon University, May 2000.
Chazan, D, et al., "Speech Reconstruction from Mel Frequency Cepstral Coefficients and Pitch Frequency," Acoustics, Speech, and Signal Processing, 2000, ICASSP '00, Proceedings 20000 IEEE International Conference on vol. 3, No. pp. 1299-1302, vol. 3, 2000.

* cited by examiner

METHOD AND APPARATUS FOR MULTI-SENSORY SPEECH ENHANCEMENT

BACKGROUND OF THE INVENTION

The present invention relates to noise reduction. In particular, the present invention relates to removing noise from speech signals.

A common problem in speech recognition and speech transmission is the corruption of the speech signal by additive noise. In particular, corruption due to the speech of another speaker has proven to be difficult to detect and/or correct.

One technique for removing noise attempts to model the noise using a set of noisy training signals collected under various conditions. These training signals are received before a test signal that is to be decoded or transmitted and are used for training purposes only. Although such systems attempt to build models that take noise into consideration, they are only effective if the noise conditions of the training signals match the noise conditions of the test signals. Because of the large number of possible noises and the seemingly infinite combinations of noises, it is very difficult to build noise models from training signals that can handle every test condition.

Another technique for removing noise is to estimate the noise in the test signal and then subtract it from the noisy speech signal. Typically, such systems estimate the noise from previous frames of the test signal. As such, if the noise is changing over time, the estimate of the noise for the current frame will be inaccurate.

One system of the prior art for estimating the noise in a speech signal uses the harmonics of human speech. The harmonics of human speech produce peaks in the frequency spectrum. By identifying nulls between these peaks, these systems identify the spectrum of the noise. This spectrum is then subtracted from the spectrum of the noisy speech signal to provide a clean speech signal.

The harmonics of speech have also been used in speech coding to reduce the amount of data that must be sent when encoding speech for transmission across a digital communication path. Such systems attempt to separate the speech signal into a harmonic component and a random component. Each component is then encoded separately for transmission. One system in particular used a harmonic+noise model in which a sum-of-sinusoids model is fit to the speech signal to perform the decomposition.

In speech coding, the decomposition is done to find a parameterization of the speech signal that accurately represents the input noisy speech signal. The decomposition has no noise-reduction capability.

Recently, a system has been developed that attempts to remove noise by using a combination of an alternative sensor, such as a bone conduction microphone, and an air conduction microphone. This system is trained using three training channels: a noisy alternative sensor training signal, a noisy air conduction microphone training signal, and a clean air conduction microphone training signal. Each of the signals is converted into a feature domain. The features for the noisy alternative sensor signal and the noisy air conduction microphone signal are combined into a single vector representing a noisy signal. The features for the clean air conduction microphone signal form a single clean vector. These vectors are then used to train a mapping between the noisy vectors and the clean vectors. Once trained, the mappings are applied to a noisy vector formed from a combination of a noisy alternative sensor test signal and a noisy air conduction microphone test signal. This mapping produces a clean signal vector.

This system is less than optimum when the noise conditions of the test signals do not match the noise conditions of the training signals because the mappings are designed for the noise conditions of the training signals.

SUMMARY OF THE INVENTION

A method and system use an alternative sensor signal received from a sensor other than an air conduction microphone to estimate a clean speech value. The clean speech value is estimated without using a model trained from noisy training data collected from an air conduction microphone. Under one embodiment, correction vectors are added to a vector formed from the alternative sensor signal in order to form a filter, which is applied to the air conductive microphone signal to produce the clean speech estimate. In other embodiments, the pitch of a speech signal is determined from the alternative sensor signal and is used to decompose an air conduction microphone signal. The decomposed signal is then used to identify a clean signal estimate.

DETAILED DESCRIPTION OF ILLUSTRATIVE EMBODIMENTS

Figure 1:
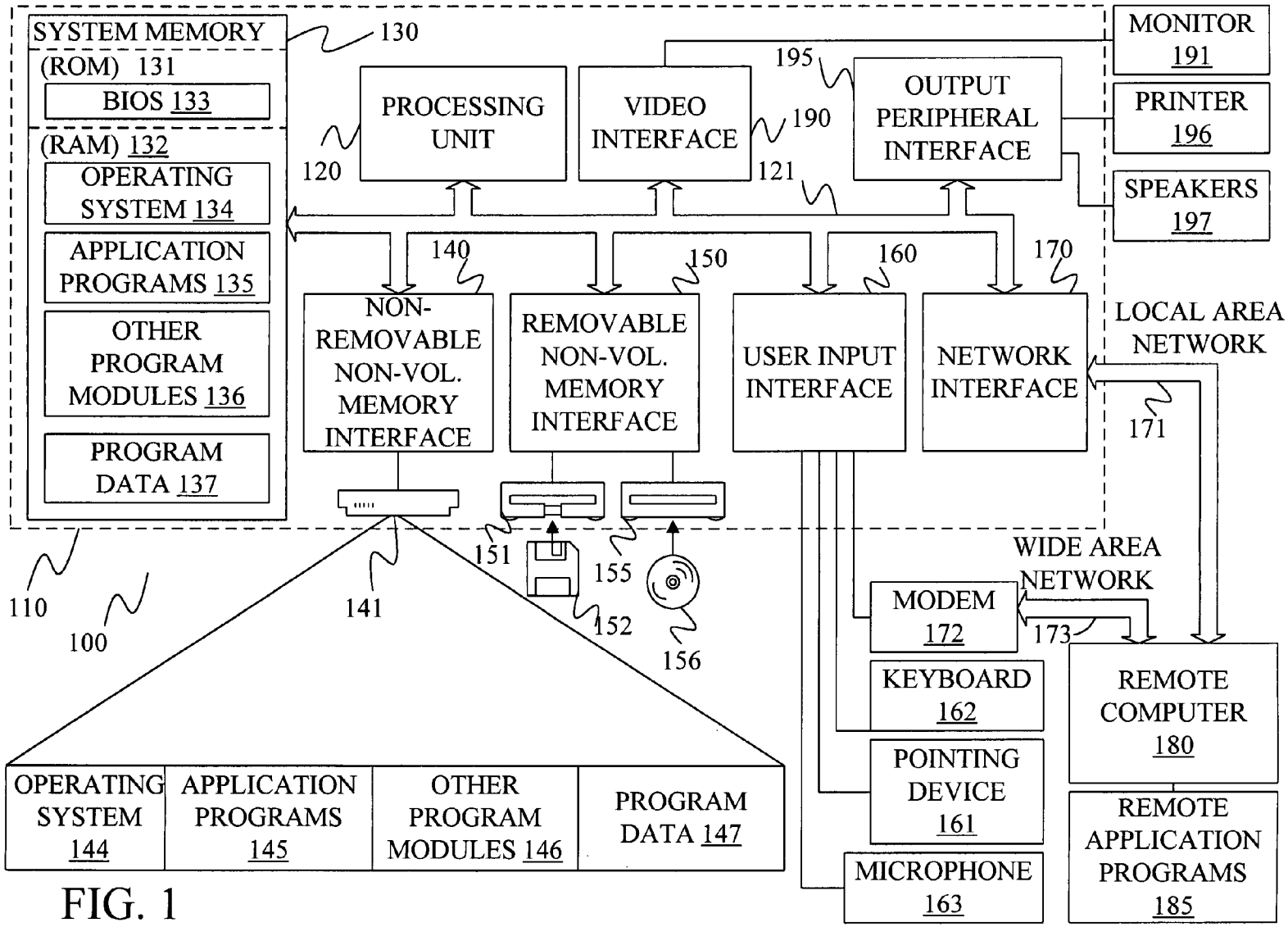
FIG. 1 is a block diagram of one computing environment in which the present invention may be practiced.

FIG. 1 illustrates an example of a suitable computing system environment 100 on which the invention may be implemented. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well-known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, telephony systems, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention is designed to be practiced in distributed computing environments where tasks are performed by remote processing devices that are linked through a communications network. In a distributed computing environment, program modules are located in both local and remote computer storage media including memory storage devices.

With reference to FIG. 1, an exemplary system for implementing the invention includes a general-purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through a non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies.

A user may enter commands and information into the computer 110 through input devices such as a keyboard 162, a microphone 163, and a pointing device 161, such as a mouse, trackball or touch pad. Other input devices (not shown) may include a joystick, game pad, satellite dish, scanner, or the like. These and other input devices are often connected to the processing unit 120 through a user input interface 160 that is coupled to the system bus, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195.

The computer 110 is operated in a networked environment using logical connections to one or more remote computers, such as a remote computer 180. The remote computer 180 may be a personal computer, a hand-held device, a server, a router, a network PC, a peer device or other common network node, and typically includes many or all of the elements described above relative to the computer 110. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on remote computer 180. It will be appreciated that the network connections shown are exemplary and other means of establishing a communications link between the computers may be used.

Figure 2:
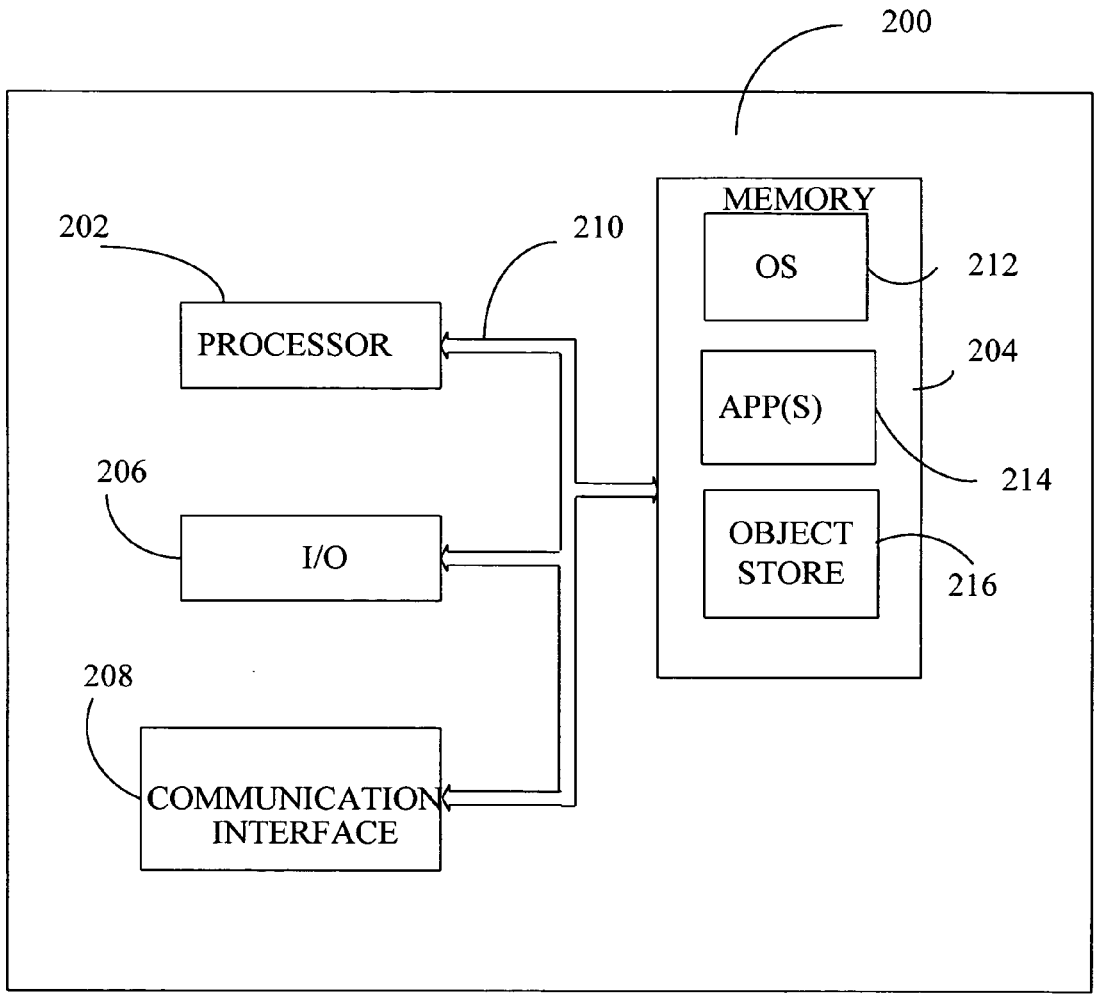
FIG. 2 is a block diagram of an alternative computing environment in which the present invention may be practiced.

FIG. 2 is a block diagram of a mobile device 200, which is an exemplary computing environment. Mobile device 200 includes a microprocessor 202, memory 204, input/output (I/O) components 206, and a communication interface 208 for communicating with remote computers or other mobile devices. In one embodiment, the afore-mentioned components are coupled for communication with one another over a suitable bus 210.

Memory 204 is implemented as non-volatile electronic memory such as random access memory (RAM) with a battery back-up module (not shown) such that information stored in memory 204 is not lost when the general power to mobile device 200 is shut down. A portion of memory 204 is preferably allocated as addressable memory for program execution, while another portion of memory 204 is preferably used for storage, such as to simulate storage on a disk drive.

Memory 204 includes an operating system 212, application programs 214 as well as an object store 216. During operation, operating system 212 is preferably executed by processor 202 from memory 204. Operating system 212, in one preferred embodiment, is a WINDOWS® CE brand operating system commercially available from Microsoft Corporation. Operating system 212 is preferably designed for mobile devices, and implements database features that can be utilized by applications 214 through a set of exposed application programming interfaces and methods. The objects in object store 216 are maintained by applications 214 and operating system 212, at least partially in response to calls to the exposed application programming interfaces and methods.

Communication interface 208 represents numerous devices and technologies that allow mobile device 200 to send and receive information. The devices include wired and wireless modems, satellite receivers and broadcast tuners to name a few. Mobile device 200 can also be directly connected to a computer to exchange data therewith. In such cases, communication interface 208 can be an infrared transceiver or a serial or parallel communication connection, all of which are capable of transmitting streaming information.

Input/output components 206 include a variety of input devices such as a touch-sensitive screen, buttons, rollers, and a microphone as well as a variety of output devices including an audio generator, a vibrating device, and a display. The devices listed above are by way of example and need not all be present on mobile device 200. In addition, other input/output devices may be attached to or found with mobile device 200 within the scope of the present invention.

Figure 3:
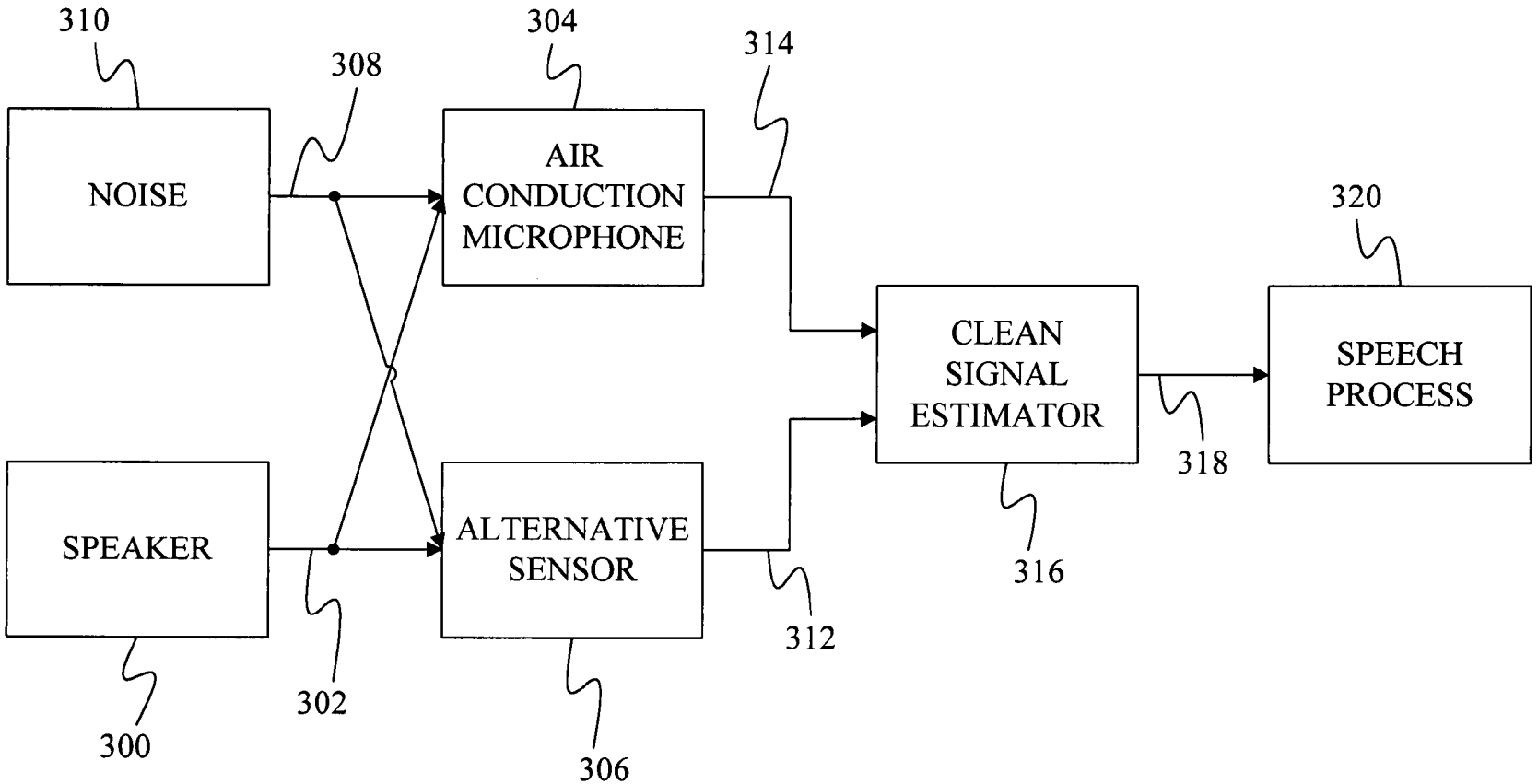
FIG. 3 is a block diagram of a general speech processing system of the present invention.

FIG. 3 provides a basic block diagram of embodiments of the present invention. In FIG. 3, a speaker 300 generates a speech signal 302 that is detected by an air conduction microphone 304 and an alternative sensor 306. Examples of alternative sensors include a throat microphone that measures the user's throat vibrations, a bone conduction sensor that is located on or adjacent to a facial or skull bone of the user (such as the jaw bone) or in the ear of the user and that senses vibrations of the skull and jaw that correspond to speech generated by the user. Air conduction microphone 304 is the type of microphone that is used commonly to convert audio air-waves into electrical signals.

Air conduction microphone 304 also receives noise 308 generated by one or more noise sources 310. Depending on the type of alternative sensor and the level of the noise, noise 308 may also be detected by alternative sensor 306. However, under embodiments of the present invention, alternative sensor 306 is typically less sensitive to ambient noise than air conduction microphone 304. Thus, the alternative sensor signal 312 generated by alternative sensor 306 generally includes less noise than air conduction microphone signal 314 generated by air conduction microphone 304.

Alternative sensor signal 312 and air conduction microphone signal 314 are provided to a clean signal estimator 316, which estimates a clean signal 318. Clean signal estimate 318 is provided to a speech process 320. Clean signal estimate 318 may either be a filtered time-domain signal or a feature domain vector. If clean signal estimate 318 is a time-domain signal, speech process 320 may take the form of a listener, a speech coding system, or a speech recognition system. If clean signal estimate 318 is a feature domain vector, speech process 320 will typically be a speech recognition system.

The present invention provides several methods and systems for estimating clean speech using air conduction microphone signal 314 and alternative sensor signal 312. One system uses stereo training data to train correction vectors for the alternative sensor signal. When these correction vectors are later added to a test alternative sensor vector, they provide an estimate of a clean signal vector. One further extension of this system is to first track time-varying distortion and then to incorporate this information into the computation of the correction vectors and into the estimation of clean speech.

A second system provides an interpolation between the clean signal estimate generated by the correction vectors and an estimate formed by subtracting an estimate of the current noise in the air conduction test signal from the air conduction signal. A third system uses the alternative sensor signal to estimate the pitch of the speech signal and then uses the estimated pitch to identify an estimate for the clean signal. Each of these systems is discussed separately below.

Training Stereo Correction Vectors

Figure 4:
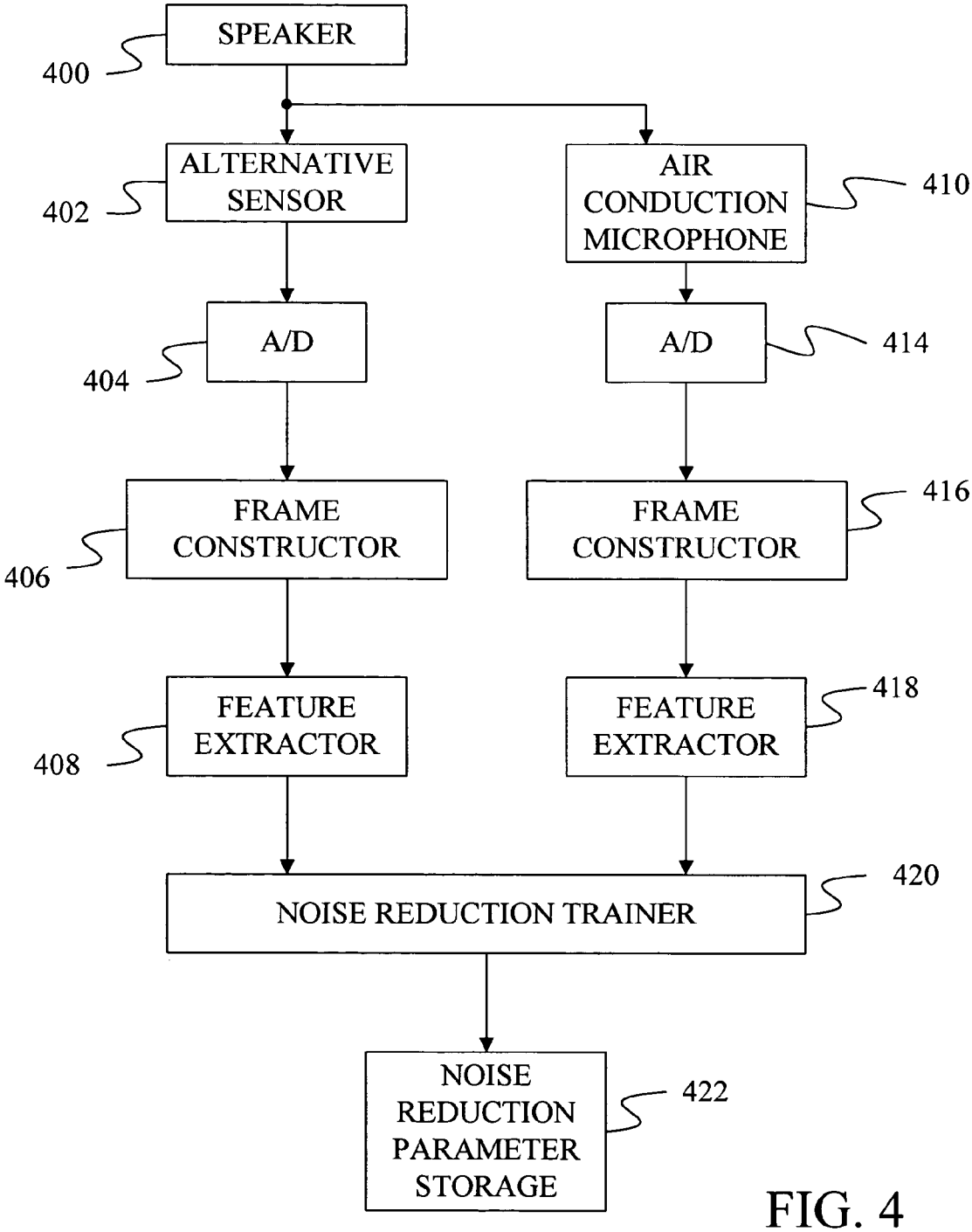
FIG. 4 is a block diagram of a system for training noise reduction parameters under one embodiment of the present invention.
Figure 5:
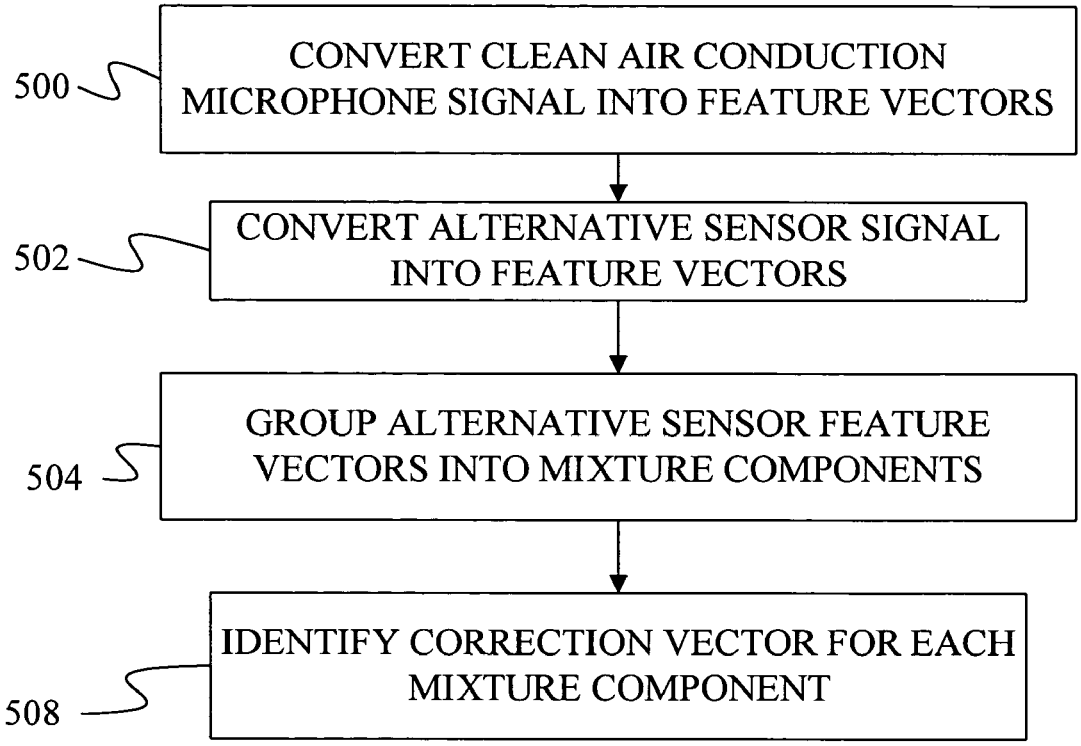
FIG. 5 is a flow diagram for training noise reduction parameters using the system of FIG. 4.

FIGS. 4 and 5 provide a block diagram and flow diagram for training stereo correction vectors for the two embodiments of the present invention that rely on correction vectors to generate an estimate of clean speech.

The method of identifying correction vectors begins in step 500 of FIG. 5, where a "clean" air conduction microphone signal is converted into a sequence of feature vectors. To do this, a speaker 400 of FIG. 4, speaks into an air conduction microphone 410, which converts the audio waves into electrical signals. The electrical signals are then sampled by an analog-to-digital converter 414 to generate a sequence of digital values, which are grouped into frames of values by a frame constructor 416. In one embodiment, A-to-D converter 414 samples the analog signal at 16 kHz and 16 bits per sample, thereby creating 32 kilobytes of speech data per second and frame constructor 416 creates a new frame every 10 milliseconds that includes 25 milliseconds worth of data.

Each frame of data provided by frame constructor 416 is converted into a feature vector by a feature extractor 418.

Under one embodiment, feature extractor 418 forms cepstral features. Examples of such features include LPC derived cepstrum, and Mel-Frequency Cepstrum Coefficients. Examples of other possible feature extraction modules that may be used with the present invention include modules for performing Linear Predictive Coding (LPC), Perceptive Linear Prediction (PLP), and Auditory model feature extraction. Note that the invention is not limited to these feature extraction modules and that other modules may be used within the context of the present invention.

In step 502 of FIG. 5, an alternative sensor signal is converted into feature vectors. Although the conversion of step 502 is shown as occurring after the conversion of step 500, any part of the conversion may be performed before, during or after step 500 under the present invention. The conversion of step 502 is performed through a process similar to that described above for step 500.

Figure 11:
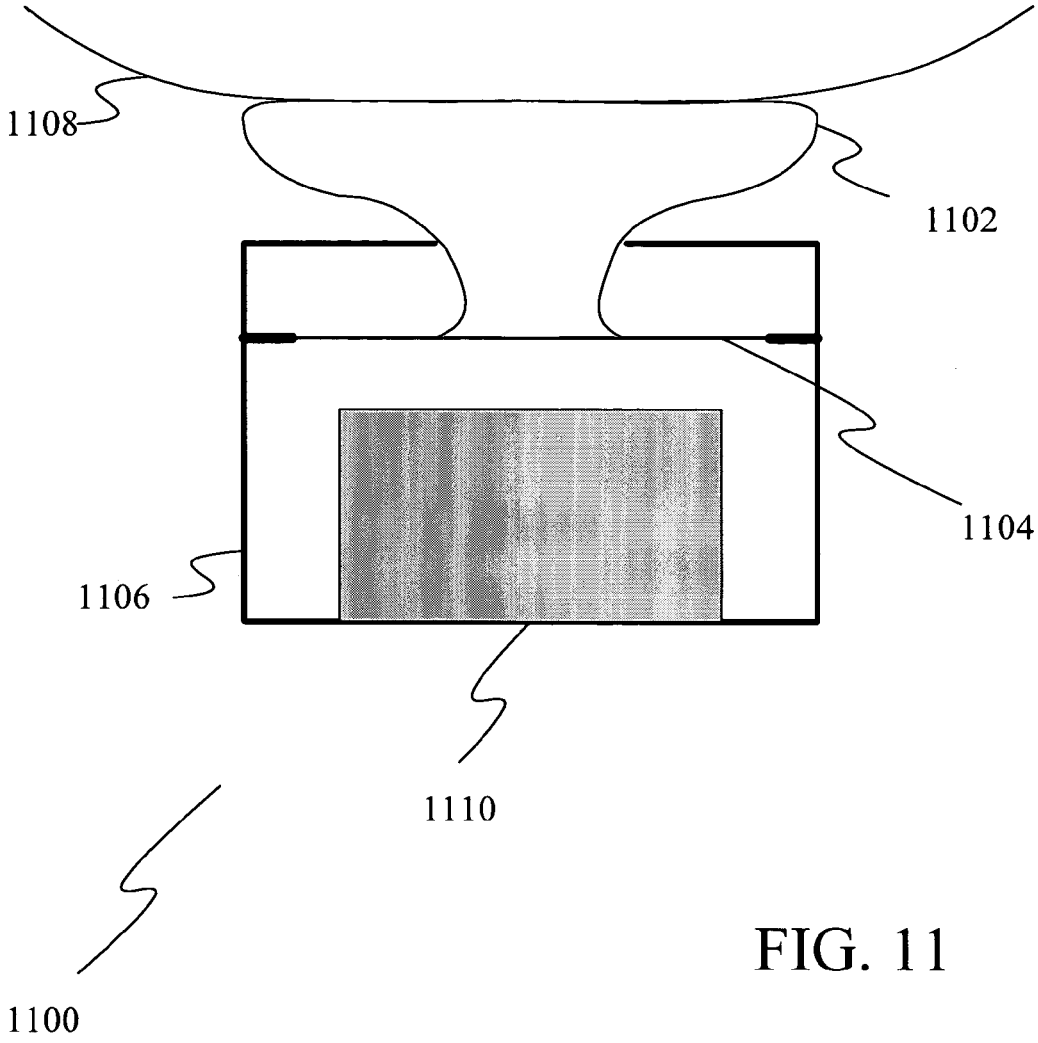
FIG. 11 is a block diagram of a bone conduction microphone.

In the embodiment of FIG. 4, this process begins when alternative sensor 402 detects a physical event associated with the production of speech by speaker 400 such as bone vibration or facial movement. As shown in FIG. 11, in one embodiment of a bone conduction sensor 1100, a soft elastomer bridge 1102 is adhered to the diaphragm 1104 of a normal air conduction microphone 1106. This soft bridge 1102 conducts vibrations from skin contact 1108 of the user directly to the diaphragm 1104 of microphone 1106. The movement of diaphragm 1104 is converted into an electrical signal by a transducer 1110 in microphone 1106. Alternative sensor 402 converts the physical event into analog electrical signal, which is sampled by an analog-to-digital converter 404. The sampling characteristics for A/D converter 404 are the same as those described above for A/D converter 414. The samples provided by A/D converter 404 are collected into frames by a frame constructor 406, which acts in a manner similar to frame constructor 416. These frames of samples are then converted into feature vectors by a feature extractor 408, which uses the same feature extraction method as feature extractor 418.

The feature vectors for the alternative sensor signal and the air conductive signal are provided to a noise reduction trainer 420 in FIG. 4. At step 504 of FIG. 5, noise reduction trainer 420 groups the feature vectors for the alternative sensor signal into mixture components. This grouping can be done by grouping similar feature vectors together using a maximum likelihood training technique or by grouping feature vectors that represent a temporal section of the speech signal together. Those skilled in the art will recognize that other techniques for grouping the feature vectors may be used and that the two techniques listed above are only provided as examples.

Noise reduction trainer 420 then determines a correction vector, $r_s$, for each mixture component, s, at step 508 of FIG. 5. Under one embodiment, the correction vector for each mixture component is determined using maximum likelihood criterion. Under this technique, the correction vector is calculated as:

$$r_s = \frac{\sum_t p(s \mid b_t)(x_t - b_t)}{\sum_t p(s \mid b_t)} \quad \text{EQ. 1}$$

Where $x_t$ is the value of the air conduction vector for frame t and $b_t$ is the value of the alternative sensor vector for frame t. In Equation 1:

$$p(s \mid b_t) = \frac{p(b_t \mid s)p(s)}{\sum_s p(b_t \mid s)p(s)} \quad \text{EQ. 2}$$

where p(s) is simply one over the number of mixture components and $p(b_t|s)$ is modeled as a Gaussian distribution:

$$p(b_t|s) = N(b_t; \mu_b, \Gamma_b) \quad \text{EQ. 3}$$

with the mean $\mu_b$ and variance $\Gamma_b$ trained using an Expectation Maximization (EM) algorithm where each iteration consists of the following steps:

$$\gamma_s(t) = p(s \mid b_t) \quad \text{EQ. 4}$$

$$\mu_s = \frac{\sum_t \gamma_s(t) b_t}{\sum_t \gamma_s(t)} \quad \text{EQ. 5}$$

$$\Gamma_s = \frac{\sum_t \gamma_s(t)(b_t - \mu_s)(b_t - \mu_s)^T}{\sum_t \gamma_s(t)} \quad \text{EQ. 6}$$

EQ. 4 is the E-step in the EM algorithm, which uses the previously estimated parameters. EQ. 5 and EQ. 6 are the M-step, which updates the parameters using the E-step results.

The E- and M-steps of the algorithm iterate until stable values for the model parameters are determined. These parameters are then used to evaluate equation 1 to form the correction vectors. The correction vectors and the model parameters are then stored in a noise reduction parameter storage 422.

After a correction vector has been determined for each mixture component at step 508, the process of training the noise reduction system of the present invention is complete. Once a correction vector has been determined for each mixture, the vectors may be used in a noise reduction technique of the present invention. Two separate noise reduction techniques that use the correction vectors are discussed below.

Noise Reduction using Correction Vector and Noise Estimate

Figure 6:
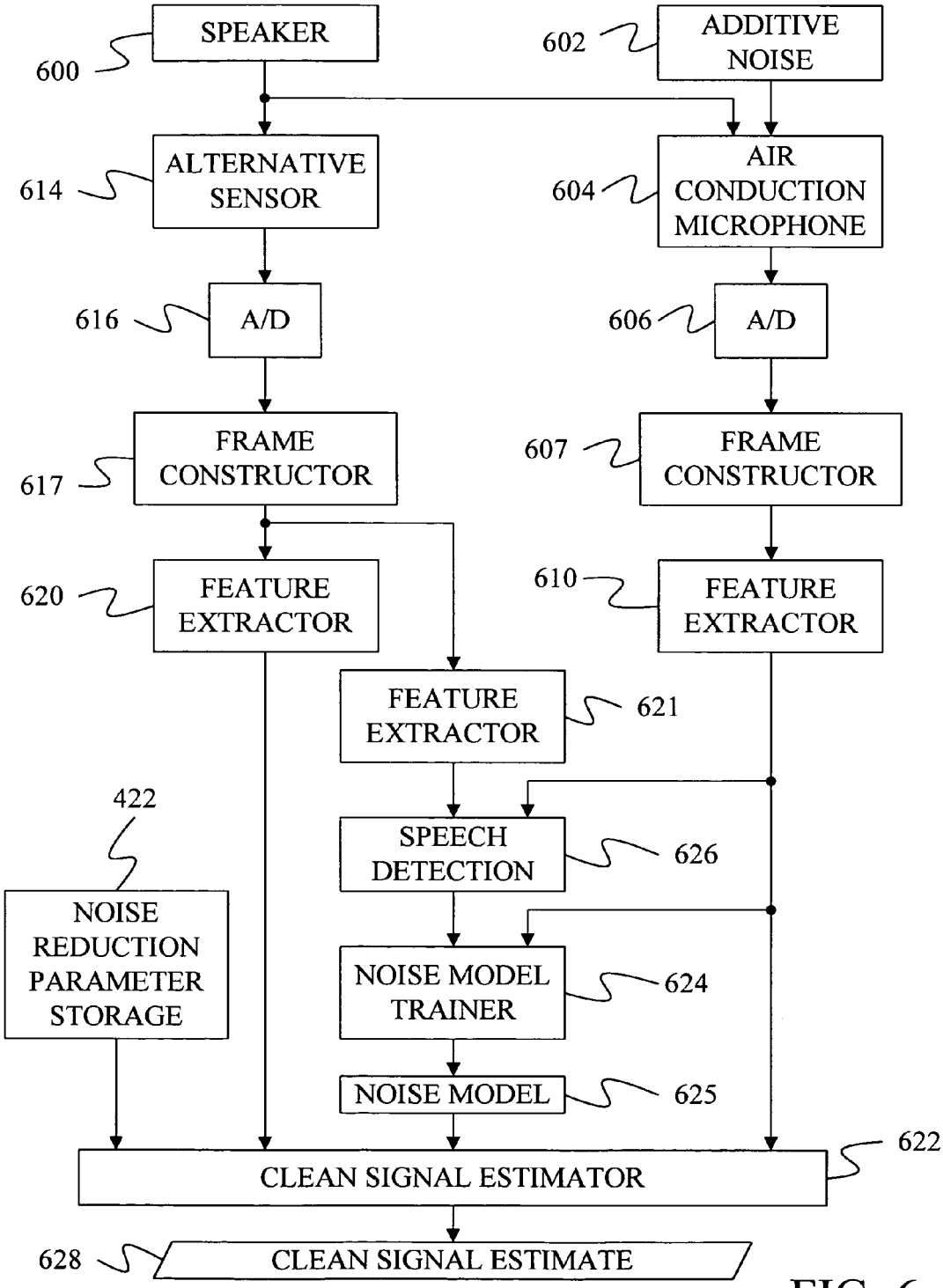
FIG. 6 is a block diagram of a system for identifying an estimate of a clean speech signal from a noisy test speech signal under one embodiment of the present invention.
Figure 7:
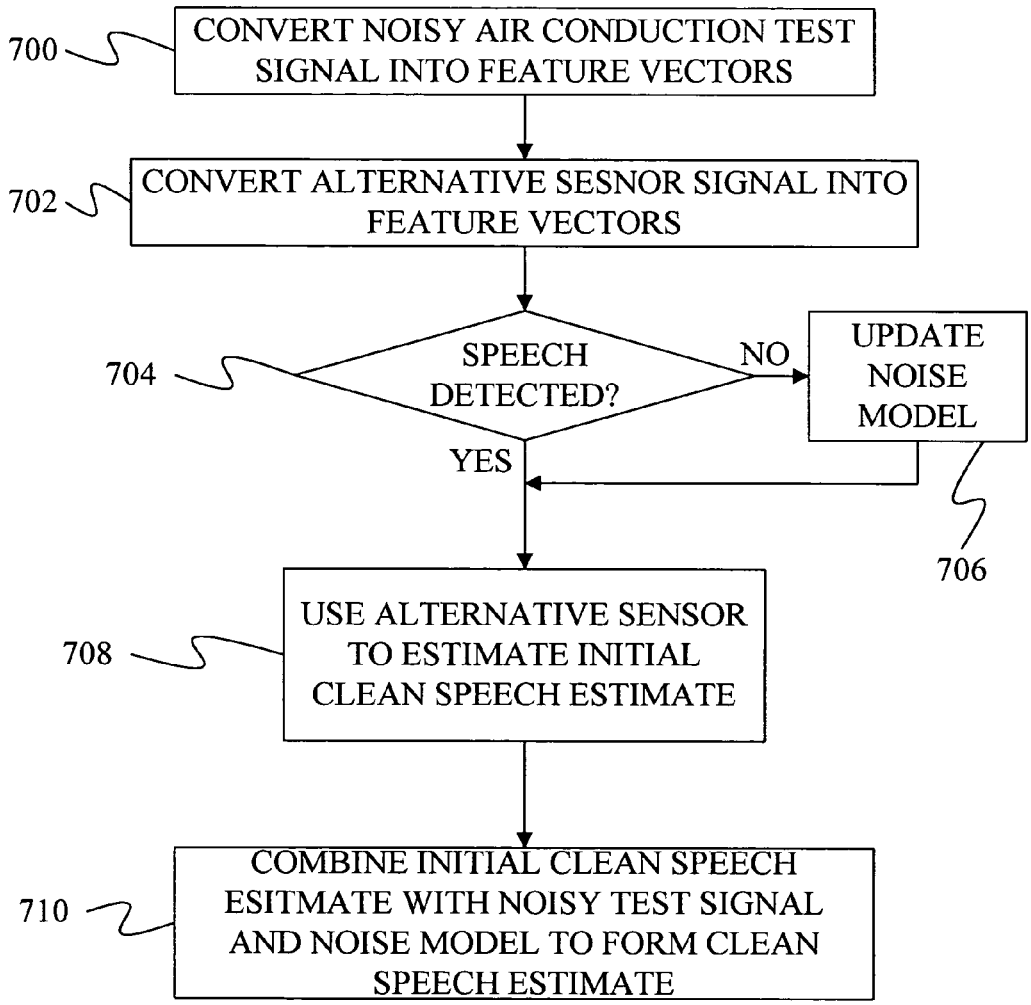
FIG. 7 is a flow diagram of a method for identifying an estimate of a clean speech signal using the system of FIG. 6.

A system and method that reduces noise in a noisy speech signal based on correction vectors and a noise estimate is shown in the block diagram of FIG. 6 and the flow diagram of FIG. 7, respectively.

At step 700, an audio test signal detected by an air conduction microphone 604 is converted into feature vectors. The audio test signal received by microphone 604 includes speech from a speaker 600 and additive noise from one or more noise sources 602. The audio test signal detected by microphone 604 is converted into an electrical signal that is provided to analog-to-digital converter 606.

A-to-D converter 606 converts the analog signal from microphone 604 into a series of digital values. In several embodiments, A-to-D converter 606 samples the analog signal at 16 kHz and 16 bits per sample, thereby creating 32 kilobytes of speech data per second. These digital values are provided to a frame constructor 607, which, in one embodiment, groups the values into 25 millisecond frames that start 10 milliseconds apart.

The frames of data created by frame constructor 607 are provided to feature extractor 610, which extracts a feature from each frame. Under one embodiment, this feature extractor is different from feature extractors 408 and 418 that were used to train the correction vectors. In particular, under this embodiment, feature extractor 610 produces power spectrum values instead of cepstral values. The extracted features are provided to a clean signal estimator 622, a speech detection unit 626 and a noise model trainer 624.

At step 702, a physical event, such as bone vibration or facial movement, associated with the production of speech by speaker 600 is converted into a feature vector. Although shown as a separate step in FIG. 7, those skilled in the art will recognize that portions of this step may be done at the same time as step 700. During step 702, the physical event is detected by alternative sensor 614. Alternative sensor 614 generates an analog electrical signal based on the physical events. This analog signal is converted into a digital signal by analog-to-digital converter 616 and the resulting digital samples are grouped into frames by frame constructor 617. Under one embodiment, analog-to-digital converter 616 and frame constructor 617 operate in a manner similar to analog-to-digital converter 606 and frame constructor 607.

The frames of digital values are provided to a feature extractor 620, which uses the same feature extraction technique that was used to train the correction vectors. As mentioned above, examples of such feature extraction modules include modules for performing Linear Predictive Coding (LPC), LPC derived cepstrum, Perceptive Linear Prediction (PLP), Auditory model feature extraction, and Mel-Frequency Cepstrum Coefficients (MFCC) feature extraction. In many embodiments, however, feature extraction techniques that produce cepstral features are used.

The feature extraction module produces a stream of feature vectors that are each associated with a separate frame of the speech signal. This stream of feature vectors is provided to clean signal estimator 622.

The frames of values from frame constructor 617 are also provided to a feature extractor 621, which in one embodiment extracts the energy of each frame. The energy value for each frame is provided to a speech detection unit 626.

At step 704, speech detection unit 626 uses the energy feature of the alternative sensor signal to determine when speech is likely present. This information is passed to noise model trainer 624, which attempts to model the noise during periods when there is no speech at step 706.

Under one embodiment, speech detection unit 626 first searches the sequence of frame energy values to find a peak in the energy. It then searches for a valley after the peak. The energy of this valley is referred to as an energy separator, d. To determine if a frame contains speech, the ratio, k, of the energy of the frame, e, over the energy separator, d, is then determined as: k=e/d. A speech confidence, q, for the frame is then determined as:

$$q = \begin{cases} 0 & : \quad k < 1 \\ \dfrac{k-1}{\alpha - 1} & : \quad 1 \le k \le \alpha \\ 1 & : \quad k > \alpha \end{cases} \qquad \text{EQ. 7}$$

where $\alpha$ defines the transition between two states and in one implementation is set to 2. Finally, we use the average confidence value of its 5 neighboring frames (including itself) as the final confidence value for this frame.

Under one embodiment, a fixed threshold value is used to determine if speech is present such that if the confidence value exceeds the threshold, the frame is considered to contain speech and if the confidence value does not exceed the threshold, the frame is considered to contain non-speech. Under one embodiment, a threshold value of 0.1 is used.

For each non-speech frame detected by speech detection unit 626, noise model trainer 624 updates a noise model 625 at step 706. Under one embodiment, noise model 625 is a Gaussian model that has a mean $\mu_n$ and a variance $\Sigma_n$. This model is based on a moving window of the most recent frames of non-speech. Techniques for determining the mean and variance from the non-speech frames in the window are well known in the art.

Correction vectors and model parameters in parameter storage 422 and noise model 625 are provided to clean signal estimator 622 with the feature vectors, b, for the alternative sensor and the feature vectors, $S_y$, for the noisy air conduction microphone signal. At step 708, clean signal estimator 622 estimates an initial value for the clean speech signal based on the alternative sensor feature vector, the correction vectors, and the model parameters for the alternative sensor. In particular, the alternative sensor estimate of the clean signal is calculated as:

$$\hat{x} = b + \sum_s p(s \mid b) r_s \qquad \text{EQ. 8}$$

where $\hat{x}$ is the clean signal estimate in the cepstral domain, b is the alternative sensor feature vector, p(s|b) is determined using equation 2 above, and $r_s$ is the correction vector for mixture component s. Thus, the estimate of the clean signal in Equation 8 is formed by adding the alternative sensor feature vector to a weighted sum of correction vectors where the weights are based on the probability of a mixture component given the alternative sensor feature vector.

At step 710, the initial alternative sensor clean speech estimate is refined by combining it with a clean speech estimate that is formed from the noisy air conduction microphone vector and the noise model. This results in a refined clean speech estimate 628. In order to combine the cepstral value of the initial clean signal estimate with the power spectrum feature vector of the noisy air conduction microphone, the cepstral value is converted to the power spectrum domain using:

$$\hat{S}_{x|b} = e^{C^{-1}\hat{x}} \qquad \text{EQ. 9}$$

where $C^{-1}$ is an inverse discrete cosine transform and $\hat{S}_{x|b}$ is the power spectrum estimate of the clean signal based on the alternative sensor.

Once the initial clean signal estimate from the alternative sensor has been placed in the power spectrum domain, it can be combined with the noisy air conduction microphone vector and the noise model as:

$$\hat{S}_x = (\Sigma_n^{-1} + \Sigma_{x|b}^{-1})^{-1} [\Sigma_n^{-1}(S_y - \mu_n) + \Sigma_{x|b}^{-1} \hat{S}_{x|b}] \qquad \text{EQ. 10}$$

where $\hat{S}_x$ is the refined clean signal estimate in the power spectrum domain, $S_y$ is the noisy air conduction microphone feature vector, $(\mu_n, \Sigma_n)$ are the mean and covariance of the prior noise model (see 624), $\hat{S}_{x|b}$ is the initial clean signal estimate based on the alternative sensor, and $\Sigma_{x|b}$ is the covariance matrix of the conditional probability distribution for the clean speech given the alternative sensor's measurement. $\Sigma_{x|b}$ can be computed as follows. Let J denote the Jacobian of the function on the right hand side of equation 9. Let $\Sigma$ be the covariance matrix of $\hat{x}$. Then the covariance of $\hat{S}_{x|b}$ is $$\Sigma_{x|b}=J\Sigma J^T \quad \text{EQ. 11}$$

In a simplified embodiment, we rewrite EQ. 10 as the following equation:

$$\hat{S}_x=\alpha(f)(S_y-\mu_n)+(1-\alpha(f))\hat{S}_{x|b} \quad \text{EQ. 12}$$

where $\alpha(f)$ is a function of both the time and the frequency band. Since the alternative sensor that we are currently using has the bandwidth up to 3 KHz, we choose $\alpha(f)$ to be 0 for the frequency band below 3 KHz. Basically, we trust the initial clean signal estimate from the alternative sensor for low frequency bands. For high frequency bands, the initial clean signal estimate from the alterative sensor is not so reliable. Intuitively, when the noise is small for a frequency band at the current frame, we would like to choose a large $\alpha(f)$ so that we use more information from the air conduction microphone for this frequency band. Otherwise, we would like to use more information from the alternative sensor by choosing a small $\alpha(f)$. In one embodiment, we use the energy of the initial clean signal estimate from the alternative sensor to determine the noise level for each frequency band. Let E(f) denote the energy for frequency band f. Let $M=\mathrm{Max}_f E(f)$. $\alpha(f)$, as a function of f, is defined as follows:

$$\alpha(f)=\begin{cases} \frac{E(f)}{M} & : \quad f \geq 4K \\ \frac{f-3K}{1K}\alpha(4K) & : \quad 3K < f < 4K \\ 0 & : \quad f \leq 3K \end{cases} \quad \text{EQ. 13}$$

where we use a linear interpolation to transition from 3K to 4K to ensure the smoothness of $\alpha(f)$.

The refined clean signal estimate in the power spectrum domain may be used to construct a Wiener filter to filter the noisy air conduction microphone signal. In particular, the Wiener filter, H, is set such that:

$$H=\frac{\hat{S}_x}{S_y} \quad \text{EQ. 14}$$

This filter can then be applied against the time domain noisy air conduction microphone signal to produce a noise-reduced or clean time-domain signal. The noise-reduced signal can be provided to a listener or applied to a speech recognizer.

Note that Equation 12 provides a refined clean signal estimate that is the weighted sum of two factors, one of which is a clean signal estimate from an alternative sensor. This weighted sum can be extended to include additional factors for additional alternative sensors. Thus, more than one alternate sensor may be used to generate independent estimates of the clean signal. These multiple estimates can then be combined using equation 12.

Noise Reduction using Correction Vector without Noise Estimate

Figure 8:
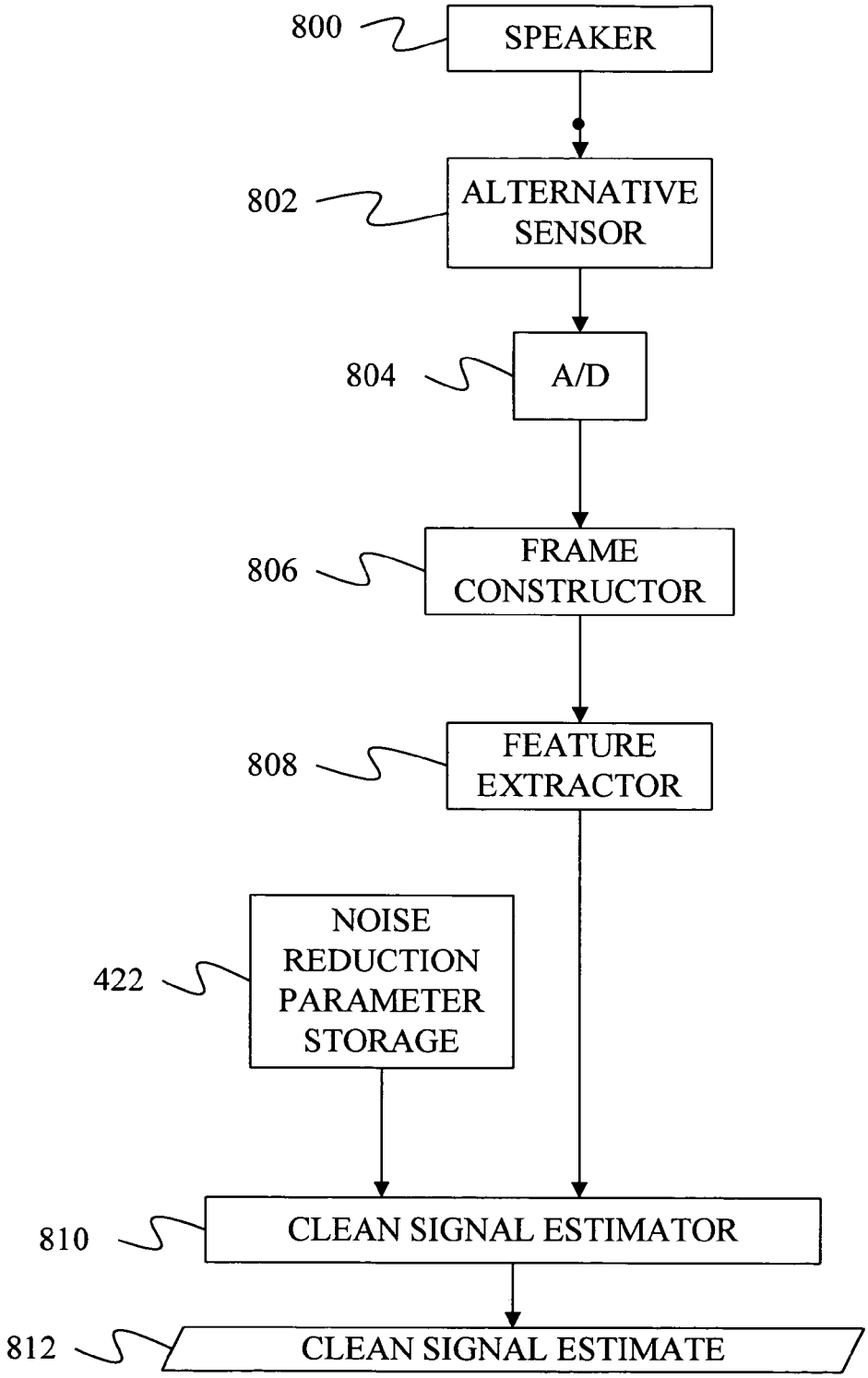
FIG. 8 is a block diagram of an alternative system for identifying an estimate of a clean speech signal.

FIG. 8 provides a block diagram of an alternative system for estimating a clean speech value under the present invention. The system of FIG. 8 is similar to the system of FIG. 6 except that the estimate of the clean speech value is formed without the need for an air conduction microphone or a noise model.

In FIG. 8, a physical event associated with a speaker 800 producing speech is converted into a feature vector by alternative sensor 802, analog-to-digital converter 804, frame constructor 806 and feature extractor 808, in a manner similar to that discussed above for alternative sensor 614, analog-to-digital converter 616, frame constructor 617 and feature extractor 618 of FIG. 6. The feature vectors from feature extractor 808 and the noise reduction parameters 422 are provided to a clean signal estimator 810, which determines an estimate of a clean signal value 812, $\hat{S}_{x|b}$, using equations 8 and 9 above.

The clean signal estimate, $\hat{S}_{x|b}$, in the power spectrum domain may be used to construct a Wiener filter to filter a noisy air conduction microphone signal. In particular, the Wiener filter, H, is set such that:

$$H=\frac{\hat{S}_{x|b}}{S_y} \quad \text{EQ. 15}$$

This filter can then be applied against the time domain noisy air conduction microphone signal to produce a noise-reduced or clean signal. The noise-reduced signal can be provided to a listener or applied to a speech recognizer.

Alternatively, the clean signal estimate in the cepstral domain, $\hat{x}$, which is calculated in Equation 8, may be applied directly to a speech recognition system.

Noise Reduction Using Pitch Tracking

Figure 9:
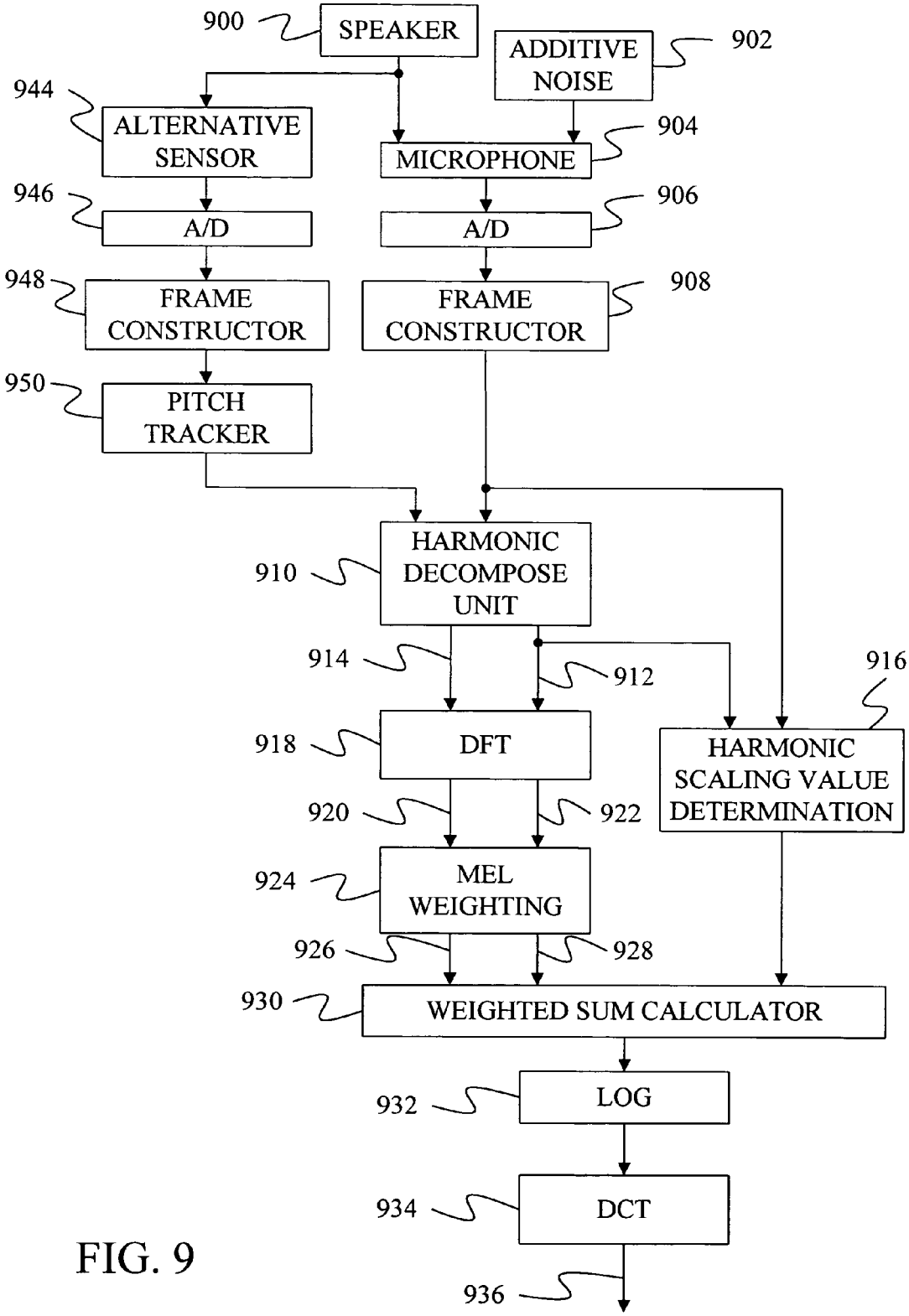
FIG. 9 is a block diagram of a second alternative system for identifying an estimate of a clean speech signal.
Figure 10:
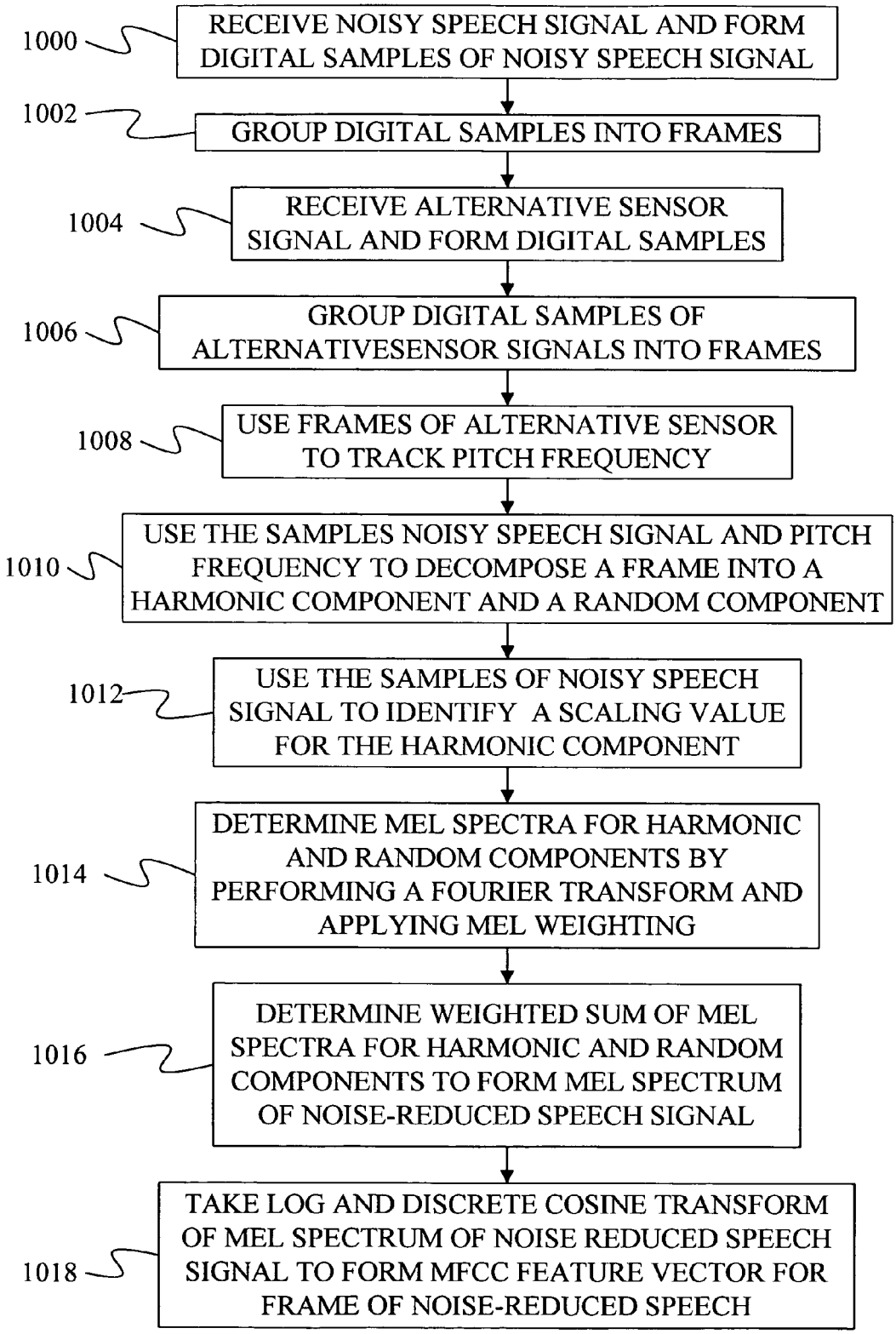
FIG. 10 is a flow diagram of a method for identifying an estimate of a clean speech signal using the system of FIG. 9.

An alternative technique for generating estimates of a clean speech signal is shown in the block diagram of FIG. 9 and the flow diagram of FIG. 10. In particular, the embodiment of FIGS. 9 and 10 determine a clean speech estimate by identifying a pitch for the speech signal using an alternative sensor and then using the pitch to decompose a noisy air conduction microphone signal into a harmonic component and a random component. Thus, the noisy signal is represented as:

$$y=y_h+y_r \quad \text{EQ. 16}$$

where y is the noisy signal, $y_h$ is the harmonic component, and $y_r$ is the random component. A weighted sum of the harmonic component and the random component are used to form a noise-reduced feature vector representing a noise-reduced speech signal.

Under one embodiment, the harmonic component is modeled as a sum of harmonically-related sinusoids such that:

$$y_h=\sum_{k=1}^{K} a_k\cos(k\omega_0 t)+b_k\sin(k\omega_0 t) \quad \text{EQ. 17}$$

where $\Omega_0$ is the fundamental or pitch frequency and K is the total number of harmonics in the signal.

Thus, to identify the harmonic component, an estimate of the pitch frequency and the amplitude parameters $\{a_1 a_2 \ldots a_k b_1 b_2 \ldots b_k\}$ must be determined.

At step 1000, a noisy speech signal is collected and converted into digital samples. To do this, an air conduction microphone 904 converts audio waves from a speaker 900 and one or more additive noise sources 902 into electrical signals. The electrical signals are then sampled by an analog-to-digital converter 906 to generate a sequence of digital values. In one embodiment, A-to-D converter 906 samples the analog signal at 16 kHz and 16 bits per sample, thereby creating 32 kilobytes of speech data per second. At step 1002, the digital samples are grouped into frames by a frame constructor 908. Under one embodiment, frame constructor 908 creates a new frame every 10 milliseconds that includes 25 milliseconds worth of data.

At step 1004, a physical event associated with the production of speech is detected by alternative sensor 944. In this embodiment, an alternative sensor that is able to detect harmonic components, such as a bone conduction sensor, is best suited to be used as alternative sensor 944. Note that although step 1004 is shown as being separate from step 1000, those skilled in the art will recognize that these steps may be performed at the same time. The analog signal generated by alternative sensor 944 is converted into digital samples by an analog-to-digital converter 946. The digital samples are then grouped into frames by a frame constructer 948 at step 1006.

At step 1008, the frames of the alternative sensor signal are used by a pitch tracker 950 to identify the pitch or fundamental frequency of the speech.

An estimate for the pitch frequency can be determined using any number of available pitch tracking systems. Under many of these systems, candidate pitches are used to identify possible spacing between the centers of segments of the alternative sensor signal. For each candidate pitch, a correlation is determined between successive segments of speech. In general, the candidate pitch that provides the best correlation will be the pitch frequency of the frame. In some systems, additional information is used to refine the pitch selection such as the energy of the signal and/or an expected pitch track.

Given an estimate of the pitch from pitch tracker 950, the air conduction signal vector can be decomposed into a harmonic component and a random component at step 1010. To do so, equation 17 is rewritten as:

$$y=Ab \qquad \text{EQ. 18}$$

where y is a vector of N samples of the noisy speech signal, A is an N×2K matrix given by:

$$A=[A_{cos}A_{sin}] \qquad \text{EQ. 19}$$

with elements $$A_{cos}(k,t)=\cos(k\omega_0 t)\ A_{sin}(k,t)=\sin(k\omega_0 t) \qquad \text{EQ. 20}$$

and b is a 2K×1 vector given by:

$$b^T=[a_1 a_2 \ldots a_k b_1 b_2 \ldots b_k] \qquad \text{EQ. 21}$$

Then, the least-squares solution for the amplitude coefficients is:

$$\hat{b}=(A^TA)^{-1}A^Ty \qquad \text{EQ. 22}$$

Using $\hat{b}$, an estimate for the harmonic component of the noisy speech signal can be determined as:

$$y_h=A\hat{b} \qquad \text{EQ. 23}$$

An estimate of the random component is then calculated as:

$$y_r=y-y_h \qquad \text{EQ. 24}$$

Thus, using equations 18-24 above, harmonic decompose unit 910 is able to produce a vector of harmonic component samples 912, $y_h$, and a vector of random component samples 914, $y_r$.

After the samples of the frame have been decomposed into harmonic and random samples, a scaling parameter or weight is determined for the harmonic component at step 1012. This scaling parameter is used as part of a calculation of a noise-reduced speech signal as discussed further below. Under one embodiment, the scaling parameter is calculated as:

$$\alpha_h=\frac{\sum_i y_h(i)^2}{\sum_i y(i)^2} \qquad \text{EQ. 25}$$

where $\alpha_h$ is the scaling parameter, $y_h(t)$ is the ith sample in the vector of harmonic component samples $y_h$ and y(i) is the ith sample of the noisy speech signal for this frame. In Equation 25, the numerator is the sum of the energy of each sample of the harmonic component and the denominator is the sum of the energy of each sample of the noisy speech signal. Thus, the scaling parameter is the ratio of the harmonic energy of the frame to the total energy of the frame.

In alternative embodiments, the scaling parameter is set using a probabilistic voiced-unvoiced detection unit. Such units provide the probability that a particular frame of speech is voiced, meaning that the vocal cords resonate during the frame, rather than unvoiced. The probability that the frame is from a voiced region of speech can be used directly as the scaling parameter.

After the scaling parameter has been determined or while it is being determined, the Mel spectra for the vector of harmonic component samples and the vector of random component samples are determined at step 1014. This involves passing each vector of samples through a Discrete Fourier Transform (DFT) 918 to produce a vector of harmonic component frequency values 922 and a vector of random component frequency values 920. The power spectra represented by the vectors of frequency values are then smoothed by a Mel weighting unit 924 using a series of triangular weighting functions applied along the Mel scale. This results in a harmonic component Mel spectral vector 928, $Y_h$, and a random component Mel spectral vector 926, $Y_r$.

At step 1016, the Mel spectra for the harmonic component and the random component are combined as a weighted sum to form an estimate of a noise-reduced Mel spectrum. This step is performed by weighted sum calculator 930 using the scaling factor determined above in the following equation:

$$\hat{X}(t)=\alpha_h(t)Y_h(t)+\alpha_r Y_r(t) \qquad \text{EQ. 26}$$

where $\hat{X}(t)$ is the estimate of the noise-reduced Mel spectrum, $Y_h(t)$ is the harmonic component Mel spectrum, $Y_r(t)$ is the random component Mel spectrum, $\alpha_h(t)$ is the scaling factor determined above, $\alpha_r$ is a fixed scaling factor for the random component that in one embodiment is set equal to 0.1, and the time index t is used to emphasize that the scaling factor for the harmonic component is determined for each frame while the scaling factor for the random component remains fixed. Note that in other embodiments, the scaling factor for the random component may be determined for each frame.

After the noise-reduced Mel spectrum has been calculated at step 1016, the log 932 of the Mel spectrum is determined and then is applied to a Discrete Cosine Transform 934 at step 1018. This produces a Mel Frequency Cepstral Coefficient (MFCC) feature vector 936 that represents a noise-reduced speech signal.

A separate noise-reduced MFCC feature vector is produced for each frame of the noisy signal. These feature vectors may be used for any desired purpose including speech enhancement and speech recognition. For speech enhancement, the MFCC feature vectors can be converted into the power spectrum domain and can be used with the noisy air conduction signal to form a Weiner filter.

Although the present invention has been described with reference to particular embodiments, workers skilled in the art will recognize that changes may be made in form and detail without departing from the spirit and scope of the invention.

What is claimed is:

1. A method of determining an estimate for a noise-reduced value representing a portion of a noise-reduced speech signal, the method comprising:

generating an alternative sensor signal using an alternative sensor other than an air conduction microphone;

converting the alternative sensor signal into at least one alternative sensor vector in the cepstral domain;

adding a weighted sum of a plurality of correction vectors to the alternative sensor vector to form the estimate for the noise-reduced value in the cepstral domain, wherein each correction vector corresponds to a mixture component and each weight applied to a correction vector is based on the probability of the correction vector's mixture component given the alternative sensor vector;

generating an air conduction microphone signal;

converting the air conduction microphone signal into an air conduction vector in the power spectrum domain;

estimating a noise value;

subtracting the noise value from the air conduction vector to form an air conduction estimate in the power spectrum domain;

converting the estimate of the noise-reduced value from the cepstral domain to the power spectrum domain; and combining the air conduction estimate and the estimate for the noise-reduced value in the power spectrum domain to form the refined estimate for the noise-reduced value in the power spectrum domain.

2. The method of claim 1 wherein generating an alternative sensor signal comprises using a bone conduction microphone to generate the alternative sensor signal.

3. The method of claim 1 further comprising training a correction vector through steps comprising:

generating an alternative sensor training signal;

converting the alternative sensor training signal into an alternative sensor training vector;

generating a clean air conduction microphone training signal;

converting the clean air conduction microphone training signal into an air conduction training vector; and using the difference between the alternative sensor training vector and the air conduction training vector to form the correction vector.

4. The method of claim 3 wherein training a correction vector further comprises training a separate correction vector for each of the plurality of mixture components.

5. The method of claim 1 further comprising using the refined estimate for the noise-reduced value to form a filter.

6. The method of claim 1 further comprising:

generating a second alternative sensor signal using a second alternative sensor other than an air conduction microphone;

converting the second alternative sensor signal into at least one second alternative sensor vector;

adding a correction vector to the second alternative sensor vector to form a second estimate for the noise-reduced value; and combining the estimate for the noise-reduced value with the second estimate for the noise-reduced value to form a refined estimate for the noise-reduced value.

7. A method of determining an estimate of a clean speech value, the method comprising:

receiving an alternative sensor signal from a sensor other than an air conduction microphone;

receiving a noisy air conduction microphone signal from an air conduction microphone;

identifying which frequency of a group of candidate frequencies is a pitch frequency for a speech signal based on the alternative sensor signal;

using the pitch frequency to decompose the noisy air conduction microphone signal into a harmonic component and a residual component by modeling the harmonic component as a sum of sinusoids that are harmonically related to the pitch; and using the harmonic component and the residual component to estimate the clean speech value by determining a weighted sum of the harmonic component and the residual component, the clean speech value representing a noise- reduced signal having reduced noise relative to the noisy air conduction microphone signal.

8. The method of claim 7 wherein receiving an alternative sensor signal comprises receiving an alternative sensor signal from a bone conduction microphone.

9. A computer-readable storage medium storing computer-executable instructions for performing steps comprising:

receiving an alternative sensor signal from an alternative sensor that is not an air conduction microphone;

receiving a noisy test signal from an air conductive microphone; generating a noise model from the noisy test signal, the noise model comprising a mean and a covariance;

converting the noisy test signal into at least one noisy test vector;

subtracting the mean of the noise model from the noisy test vector to form a difference;

forming an alternative sensor vector from the alternative sensor signal;

adding a correction vector to the alternative sensor vector to form an alternative sensor estimate of a clean speech value; and setting a weighted sum of the difference and the alternative sensor estimate as an estimate of the clean speech value, wherein the weighted sum is computed using the covariance of the noise model to compute weights for the weighted sum.

10. The computer-readable storage medium of claim 9 wherein receiving an alternative sensor signal comprises receiving a sensor signal from a bone conduction microphone.

11. The computer-readable storage medium of claim 9 wherein adding a correction vector comprises adding a weighted sum of a plurality of correction vectors, each correction vector being associated with a separate mixture component.

12. The computer-readable storage medium of claim 11 wherein adding a weighted sum of a plurality of correction vectors comprises using a weight that is based on the probability of a mixture component given the alternative sensor vector.

13. The computer-readable storage medium of claim 9 wherein the estimate of the clean speech value is in the power spectrum domain.

14. The computer-readable storage medium of claim 13 further comprising using the estimate of the clean speech value to form a filter.

15. The computer-readable storage medium of claim 9 further comprising:

receiving a second alternative sensor signal from a second alternative sensor that is not an air conduction microphone; and using the second alternative sensor signal with the alternative sensor signal to estimate the clean speech value.

* * * * *